United States Patent [19]

Varon et al.

[11] Patent Number: 4,535,525

[45] Date of Patent: Aug. 20, 1985

[54] ADAPTER FOR BRACKET SECUREMENT TO WALL STUDS AND METHOD OF MANUFACTURE

[75] Inventors: David Varon, Highland Park; Steven C. Dorner, Western Springs; Burton L. Siegal, Skokie, all of Ill.

[73] Assignee: Crown Metal Mfg. Company, Chicago, Ill.

[21] Appl. No.: 576,360

[22] Filed: Feb. 2, 1984

Related U.S. Application Data

[62] Division of Ser. No. 295,487, Aug. 24, 1981, Pat. No. 4,443,979.

[51] Int. Cl.[3] ..... B21D 39/02

[52] U.S. Cl. ..... 29/463; 29/509; 29/514; 29/515; 29/525; 248/243

[58] Field of Search ..... 29/463, 525, 509, 514; 52/36, 732, 730, 731; 211/134; 248/243

[56] References Cited

U.S. PATENT DOCUMENTS

| | | | |
|---|---|---|---|
| 1,823,158 | 9/1931 | Mogford et al. | 29/521 X |
| 3,113,083 | 12/1963 | Silvester | 29/514 UX |
| 3,828,495 | 8/1974 | Law | 248/211 X |
| 3,848,364 | 11/1974 | Costruba | 52/731 X |
| 3,888,063 | 6/1975 | Frantz | 29/515 X |

FOREIGN PATENT DOCUMENTS

| | | | |
|---|---|---|---|
| 6555 | 1/1980 | European Pat. Off. | 29/514 |
| 2825301 | 12/1979 | Fed. Rep. of Germany | 29/515 |

*Primary Examiner*—Charlie T. Moon

*Attorney, Agent, or Firm*—Silverman, Cass & Singer, Ltd.

[57] ABSTRACT

An adapter for enabling a vertical slotted standard in the form of a steel bar to be mounted to a pair of back-to-back assembled sheet metal channel-shaped studs in a wall, the adapter being disposed within the wall and hidden from the exterior of the wall. The exterior covering of the wall comprises aligned adjacent wallboard members whose vertical adjacent edges engage against a pair of forwardly extending entrance flanges for receiving therein the shelf-supporting hooked end brackets which enter and engage within the slots of the standard. The wallboard members are secured to the studs with the same fasteners that connect a pair of wallboard-receiving wings of the adapter to the studs. The invention is concerned with means for anchoring the standard within the adapter and a method of effecting such anchoring during the assembly of the adapter.

6 Claims, 9 Drawing Figures

ADAPTER FOR BRACKET SECUREMENT TO WALL STUDS AND METHOD OF MANUFACTURE

This application is a division, of application Ser. No. 295,487, filed Aug. 24, 1981, now U.S. Pat. No. 4,443,979.

FIELD OF THE INVENTION

The field of the invention comprises support structure for shelving and more particularly the field of the invention is the type of structure which is combined with a form of drywall construction using sheet steel studs, especially for commercial establishments. The actual support for the shelving is obtained through the use of slotted standards having brackets hooked into the slots of the standards but the standards being hidden in the walls.

BACKGROUND OF THE INVENTION

Shelving support structure using slotted standards with metal brackets hooked into these standards is very well known. The conventional arrangement uses channel-shaped slotted standards which are mounted to walls with the channel webs facing outwardly, presenting the slots to the user for the insertion of the hooks of the brackets. Such structure is popular because it is easy to install and enables the brackets to be located at different levels which are capable of being changed from time to time.

This type of arrangement does not provide particularly attractive installations because the standards are exposed. Accordingly there have been structures which have hidden slotted standards, these being especially desired by commercial establishments which require shelving for the display of their merchandise but do not want the standards exposed.

This invention is concerned with a structure that enables the standards to be mounted to the interior studs of a wall of the so-called drywall construction, the arrangement resulting in vertical grooves that lead to the standards. The user inserts the brackets into the vertical grooves and manipulates them to cause their hooks to engage with the slots of the hidden standards.

Several different types of hidden standard structures are known. Most of these require special studs which causes the installations to be expensive. Other types use conventional studs and different methods of securing the standards in place.

This invention is primarily concerned with a type of structure which enables the use of conventional sheet metal studs in the wall. Such studs are channel shaped and provide for interior spacing within the wall between its wallboard coverings of $3\frac{5}{8}$ inches. Wallboard normally comes in thicknesses of $\frac{1}{8}$ inch or $\frac{3}{8}$ inch. The invention provides an adapter so that a slotted standard may be installed within the wall, held in place by the adapter and a pair of back-to-back conventional sheet metal studs. The adapter is arranged such that the wallboard can be screwed to the studs as in conventional installations but leaving a space between adjacent wallboard members to form the grooves for the insertion of the hooked brackets.

The adapter of the invention is formed from extruded aluminum shapes which are assembled during manufacture with the slotted standard in a novel structure and by a novel method.

The adapter and method of the invention comprise improvements over the prior art affording greater simplicity and economy of construction and by providing a type of structure in which the slotted standard is positively gripped within the housing of the adapter and can support substantial weight without danger of shifting.

Waverunek Pat. No. 3,730,477 proposes a bracket support unit for integral wall construction that is to be used for the same purpose as the adapter of the invention but the construction and manner of assembly of the wall unit give rise to certain disadvantages which are eliminated by the invention herein in an unobvious manner.

The bracket support unit of U.S. Pat. No. 3,730,477 utilizes an integral extruded aluminum member which has wings for overlying the stud flanges, a pair of forwardly extending entrance flanges to receive the hooked ends of brackets, a box-like housing to be interposed between the webs of the studs and flanges forming a slotted standard receiving channel. All of these are formed as a single member such that the slotted standard is in the form of a flat strip or bar of steel and must be slid into the receiving channel and staked in place.

In order to secure the steel bar forming the slotted standard in place in said structure of U.S. Pat. No. 3,730,477 the bar is notched along its edges before it is inserted into the standard receiving channel and after so assembling a staking tool or punch is struck against the front face of the support unit in the wings alongisde the entrance flanges. The intention is to cause anchoring projections of the aluminum extrusion to be pressed into the notches. Inasmuch as the notches are hidden when the steel slotted bar is inserted into its channel the staking or punching operation must be effected blindly. As a result the punched projections may not align perfectly, if at all, with the notches and the device has an inherent weakness which may not become apparent until a user places excessive weight on the brackets mounted to the faulty standard. If the standard slips the slots in the standard will not align laterally with the slots of other standards and the shelving cannot properly be mounted level thereon.

Another disadvantage of this kind of structure is that the punching operation to produce the notches requires a more complex die that the one for simply punching the slots of the slotted standard. In addition, the staking or punching operation needed to form the anchoring projections is slow because it is required to be done in a punch press in an intermittent procedure.

The invention herein eliminates the disadvantages described above and provides a simplier and more effective unit for enabling the hidden slotted standard to be mounted in a wall secured to the conventional studs of the wall.

PRIOR ART

The following U.S. patents in addition to 3,730,477 comprise prior art in the general field of the invention and illustrate the general environment in which the invention is intended to be used. The manner of building and assembling the walls or fixtures with which the invention can be used are shown in some of these patents. Also the different kinds of vertical slotted standards and hooked end brackets used therewith are disclosed in these prior art patents:

| | | |
|---|---|---|
| Fuller et al | 2,558,428 | June 26, 1951 |

-continued

| | | |
|---|---|---|
| Zimmerla | 2,998,107 | Aug. 29, 1961 |
| Dahme | 3,066,774 | Dec. 4, 1962 |
| Biggs | 3,265,217 | Aug. 6, 1966 |
| Zock | 3,316,863 | May 2, 1967 |
| Doke | 3,394,507 | July 30, 1968 |
| Doke et al | 3,407,547 | Oct. 29, 1968 |
| Andrews | 3,492,766 | Feb. 3, 1970 |
| Plemeng | 3,509,669 | May 5, 1970 |
| Schwartz | 3,562,970 | Feb. 16, 1971 |
| Schwartz | 3,653,172 | Apr. 4, 1972 |
| Marks | 3,648,419 | Mar. 14, 1972 |
| Schwartz | 3,653,172 | Apr. 4, 1972 |
| Schwartz | 3,668,827 | Jun. 13, 1972 |
| Costruba | 3,714,748 | Feb. 6, 1973 |
| Costruba | 3,848,364 | Nov. 19, 1974 |

SUMMARY OF THE INVENTION

An adapter for enabling a vertical slotted standard in the form of a steel bar to be mounted to a pair of back-to-back assembled steel wall studs, the adapter being disposed in such a manner as substantially to hide the standard but provide an entrance groove to receive hooked shelve-mounting brackets therein to be hooked to the standard. The groove is formed from a pair of forwardly extending entrance flanges that are disposed between a pair of vertically arranged aligned wall-forming wallboard members secured to the studs while at the same time securing the adapter in place, the entrance flanges defining the space between the adjacent vertical edges of said wallboard members.

The adapter has a pair of lateral wallboard receiving wings and a rearwardly extending box-like housing which is mounted between the webs of the back-to-back studs and provides a channel to receive a slotted standard therein. The slots of the standard are aligned with the groove and hence the channel opens to the front of the adapter. A pair of integral interior flanges on the interior of the housing form the rear of the standard receiving channel.

The slotted standard has recesses formed in at least one of its faces adjacent and along the edges thereof and when assembled within the standard receiving channel the recesses open to the interior of the housing, that is, they open to the rear of the adapter.

The interior flanges are rolled upon the rear face of the slotted standard and the metal therefrom is forced into the recesses adjacent the edges of the standard, forming keys locking the standard in place. The invention comprises the method of assembling the adapter and the resulting device.

DESCRIPTION OF THE PREFERRED EMBODIMENTS

Generally the environment of the invention is a wall which is especially constructed to provide hidden mounting for conventional hook-ended brackets for supporting shelves. This particular type of wall would be especially desirable in retail establishments where the unsightliness of conventional channel-shaped slotted standards mounted on the exterior of the walls is desired to be eliminated.

Figure 1:
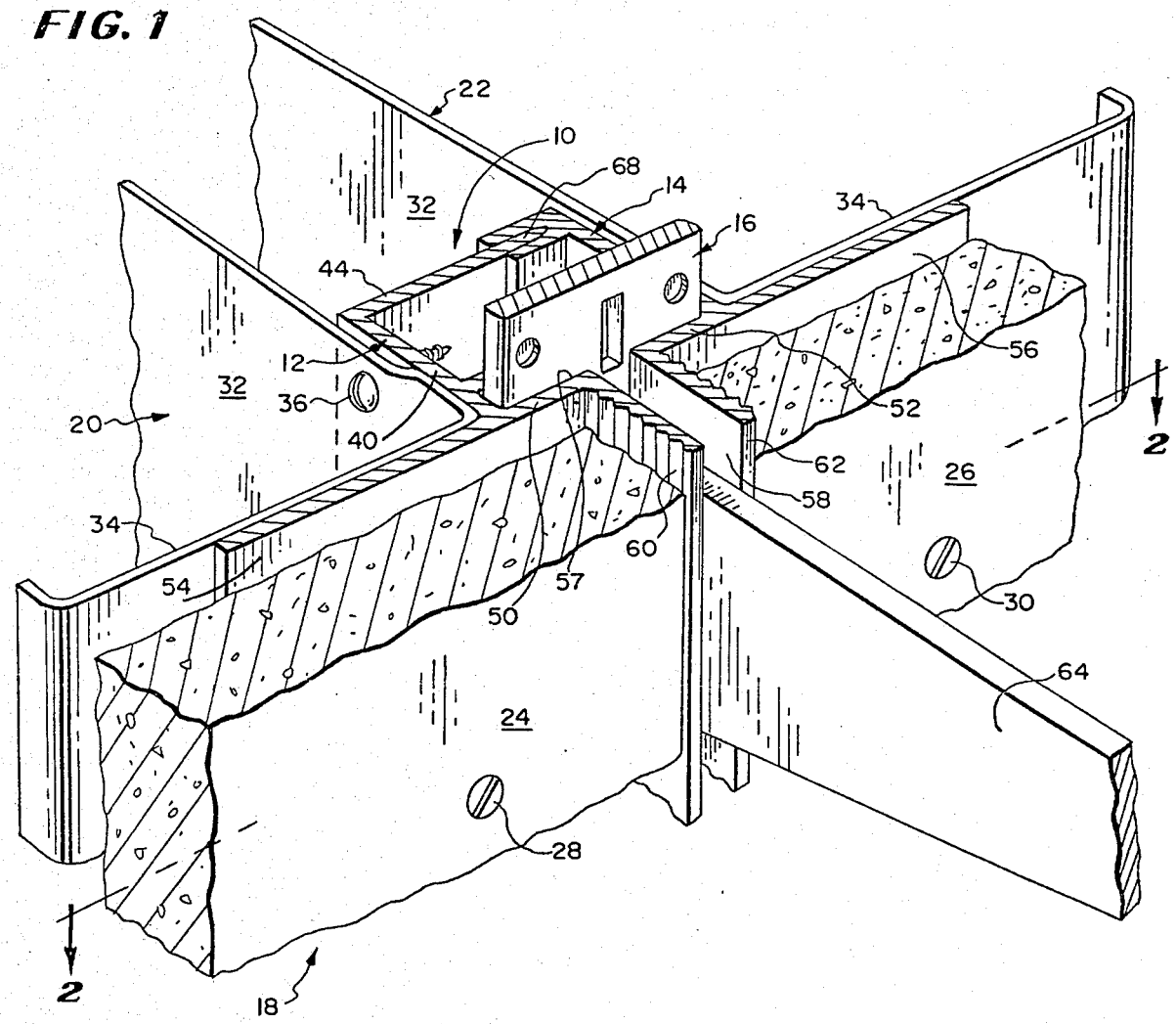
FIG. 1 is a fragmentary perspective view with parts shown in section of the stud adapter of the invention installed in a wall.
Figure 2:
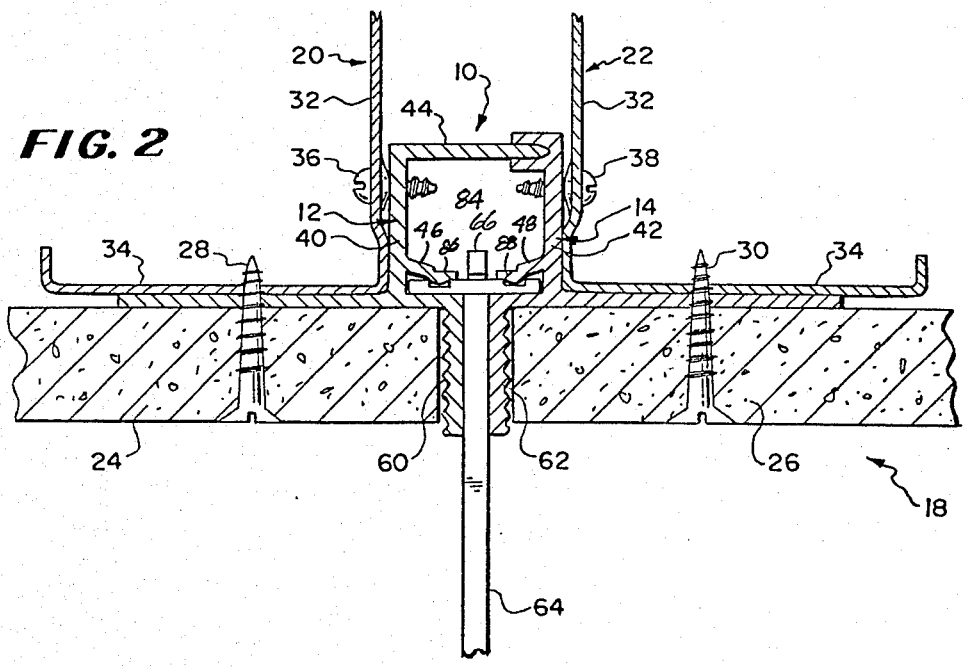
FIG. 2 is a sectional view taken generally along the line 2—2 of FIG. 1 and in the indicated direction.

In FIGS. 1 and 2 of the drawings there is illustrated a fragmentary broken away portion of a wall in which the adapter of the invention has been installed. The adapter is designated 10 and it comprises three components which consist of the two extruded aluminum members 12 and 14 forming the housing, wings and entrance flanges which will be described in more detail below and the slotted bar forming the slotted standard 16. A general discussion of the manner of use of the adapter 10 at this point may make the invention more readily understood and appreciated.

In FIG. 1 the view is of the front of the wall 18 which may be considered to be a partition in a retail establishment, perhaps between adjacent rooms or salons. Such a wall 18 if not including the invention could be formed of vertical sheet metal studs such as shown at 20 and 22 suitably footed or braced at their bottom and top ends and having rectangular sheets of wallboard secured to the studs 20 and 22. The view of FIGS. 1 and 2 show adjacent wallboard members 24 and 26 which are mounted to the flanges of the studs 20 and 22 by suitable sheet metal screws 28 and 30.

The conventional partition or wall would have one or a pair of such studs spaced about 16 inches apart along the length of the wall and with the wallboard members such as 24 and 26 mounted edge to edge. In these views it will be seen that the vertical edges of the wallboard members 24 and 26 are spaced apart for a reason which will shortly be explained.

These sheet metal studs 20 and 22 are channel-shaped and each has a central web 32 that spans the space between the covering wallboard members with right angle bent flanges which engage the back of the wallboard members such as 24 and 26. Again, in the views there is an intervening wing between each flange 34 and the covering wallboard member which will be described. There is an identical flange like 34 on the opposite edge of each stud to form the channel configuration and it will be appreciated that whatever is being described for the front of the wall that is illustrated in FIGS. 1 and 2 can be installed on the opposite wall which is not shown. The identical stud adapter arrangement can be used or, if desired, the opposite side of the wall may be covered by wallboard members without regard to that face being able to support shelving.

The assembled adapter 10 is secured to the back-to-back studs 20 and 22 between the webs 32 of the studs by means of sheet metal screws 36 and 38 which are driven through the spaced apart webs 32 into and through the walls 40 and 42 of the aluminum members 12 and 14, respectively. Typically, the distance across the adapter 10 between the studs 20 and 22 is about one inch. The adapter 10 and its opposite mate, if one is used, secure the vertical edges of the back-to-back studs together forming a relatively rigid and robust column.

Considering the adapter 10 as a whole, it is formed with a central box-like housing that is defined by the two walls 40 and 42 the back wall 44 and the slotted standard 16. The standard 16 is held in place by the integral elongate flanges 46 and 48 that clamp the standard against the front extensions 50 and 52 of the integral wallboard receiving wings 54 and 56. The flanges 46 and 48 are spaced apart to leave a space and the extensions 50 and 52 do not meet at their centers but there is nevertheless a split channel 57 formed between the flanges and extensions which are spaced apart front to rear sufficient to accommodate the thickness of the slotted standard in a sliding fit when the adapter 10 is being assembled by the manufacturer.

The spacing between the extensions 50 and 52 is shown at 58 and the right angle forwardly extending entrance flanges 60 and 62 which are integrally formed on the respective ends of the extensions 50 and 52 form the groove for receipt of the hook-ended brackets that can be inserted therein and engaged with slots of the standard 16. The entrance flanges 60 and 62 are either slightly longer than or about the same length as the thickness of the wallboard members 24 and 26 so that their edges are unobtrusive and yet identify the location of the groove 58.

As shown in FIGS. 1 and 2 when the wall 18 is constructed the groove 58 will accept one or more hook-ended brackets such as 64 whose hooks can be engaged with the slots of the standard 16 to enable shelves to be supported from the brackets. In FIG. 2 the hook 66 of a bracket 64 is shown extending past the flanges 46 and 48 into the interior of the box-like housing.

Adverting once more to the construction of the adapter 10, it will be noted that the two parts 12 and 14 are held together by a tongue and groove structure 68 in which the tongue is formed on the back wall 44 of the part 12 while the groove is formed on the rear portion of the part 14. These cooperating elements are frictionally pressed together during assembly of the adapter 10. Preferably, when the adapter is in the process of being assembled, the slotted standard is engaged laterally in the half of the channel 57 formed by one of the members 12 or 14 after which the other of these two members is fitted in place, completing the channel 57 and enclosing the slotted standard fully. At this time the tongue and groove elements 68 are forced together in an assembly.

This described method of preliminarily assembling the adapter 10 is easier to accomplish than assembling the entire adapter and then sliding the standard 16 into place. It saves an operation and in addition enables the fit of the standard in the channel 57 to be tighter without concern that there will be scoring and burrs produced when the standard is slid into place end-wise.

FIGS. 1 and 2 illustrate the wall 18 with the adapter 10 in place and in these views the adapter is fully assembled, the standard 16 being in its channel 57 and the flanges 46 and 48 being clamped against the standard. Initially these flanges are not pressed in place but are of a formation that is best seen at 70 in broken lines in FIG. 5. They are not distorted in the manner shown to enable the standard 16 to be accommodated in the channel 57 without difficulty.

The slotted standard 16 differs from conventional standards in the main respect that it is a flat steel bar instead of channel formation. There is a series of rectangular slots 72 punched through the bar along its line center, these slots being typically slightly longer than 1 inch, spaced apart on 2 inch centers and having a width of about $\frac{1}{8}$ inch. The steel stock of the standard 16 is about $\frac{1}{8}$ inch thick. These dimensions will accept universal designs of hooked end brackets such as 64. The dimensions may vary.

Figure 3:
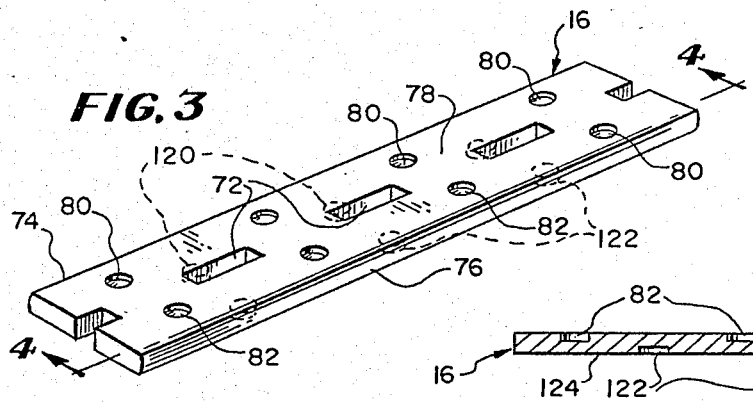
FIG. 3 is a fragmentary perspective view of the slotted steel bar which is associated with the stud adapter of the invention and which comprises the standard from which hook-ended brackets are supported.

In the invention, the edges of the standard are preferably slightly rounded as shown at 74 and 76 in FIG. 3 to assist in piloting the standard 16 into the channel 57 being formed by the parts 12 and 14 during assembly of the adapter 10.

In the rear surface 78 of the flat bar forming the standard, according to the invention, there are provided shallow spaced recesses which are formed by coining in a rolling operation, these recesses extending along the entire length of the standard 16 adjacent the opposite edges thereof. Thus there are two rows of recesses, 80 and 82, spaced about a half inch apart, one row along each edge. The recesses 80 and 82 can be about 3/32 inch in diameter and their distance from opposite edges about 3/16 inch.

These dimensions are not critical but should be chosen so that when the steel bar is disposed in its channel 57, the lines of recesses 80 and 82 will be directly under the flanges 46 and 48, respectively. The depth of the recesses 80 and 82 can be about a sixteenth of an inch or less.

After the preliminary assembly of the adapter 10 described above with the flanges 46 and 48 undistorted, they are firmly pressed against the rear surface 78 of the standard 16 all along the length of the adapter and the flanges 46 and 48 from the interior of the box-like housing. Obviously, when the standard 16 is assembled to the parts 12 and 14 the recesses 80 and 82 must open towards the inside of the box-like housing. The housing provides a relatively rectangular hollow chamber 84 along its length which, in addition to providing spacing between the studs 20 and 22 and strengthening the same, accommodates certain apparatus used to carry out the novel method of assembling the adapter.

When the flanges 46 and 48 are pressed against the surface 78 of the standard 16 the degree of pressure is sufficient to distort the flanges as shown at 86 and 88 while the aluminum immediately over each recess is forcibly extruded into said recess whereby to form locking keys 90 and 92 which permanently clamp the standard 16 in place within the channel 57. This is probably best shown in the views of FIGS. 5 and 7.

The adapter 10 is accordingly characterized by the presence of such upset or extruded locking keys 90 and 92 along its complete length holding the slotted standard permanently installed. There is no requirement to achieve a particular disposition of the standard 16 relative to the housing of the adapter along the length thereof because the process results in the locking keys 90 and 92 being formed in situ.

The preferred method of making the adapter 10 is to assemble the three parts 12, 14 and 16 together to form the housing and to roll the flanges 46 and 48 against the surface 78 of the steel bar forming the standard 16. This is done by apparatus which is shown diagrammatically in FIGS. 5 and 6.

Figure 6:
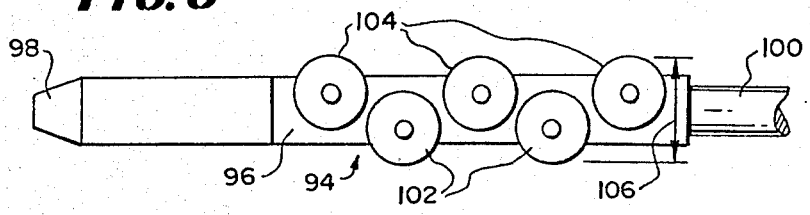
FIG. 6 is a diagrammatic view of a mandrel used for carrying out the method of FIG. 5.

In FIG. 6 there is illustrated a roller mandrel 94 consisting of a roll-carrying head 96 having a tapered pilot nose 98 and having a series of hardened steel or similar material rolls journalled thereon in suitable roller or ball bearings (not shown). The mandrel head 96 is preferably of rectangular configuration and dimensions such that it can fit within the chamber 84 and be passed through the chamber 84. It is carried on the end of a support rod 100 that is somewhat longer than the longest length of adapter 10 it is desired to produce.

The mandrel 94 is shown in side view in FIG. 6 and this is generally the disposition of the same when it passes through the assembled housing of the adapter 10 during the manufacturing process. There are two pairs of rolls shown at 102 which protrude below the head 96 and three pairs of rolls shown at 104 which protrude above the head 96. In the sectional view of FIG. 5, one pair of the rolls 102 is shown in solid lines and one pair of the rolls 104 is shown principally in broken lines. The total dimension from the outermost extent of the rolls 104 to the outermost extent of the rolls 102 is indicated at 106 and this dimension 106 is greater than the distance from the inner surface of the back wall 44 of the box-like housing of the adapter 10 to the flanges 46 and 48 at the point where the rolls 102 would engage the flanges. The dimension beyond the point where engagement would take place is increased by the amount of displacement of the flanges desired. The dimension 106 is preferably slightly less at the left end of the mandrel and increases a bit but not fully to 106 in the center so that the crushing of the flanges 46 and 48 occurs in stages.

Figure 5:
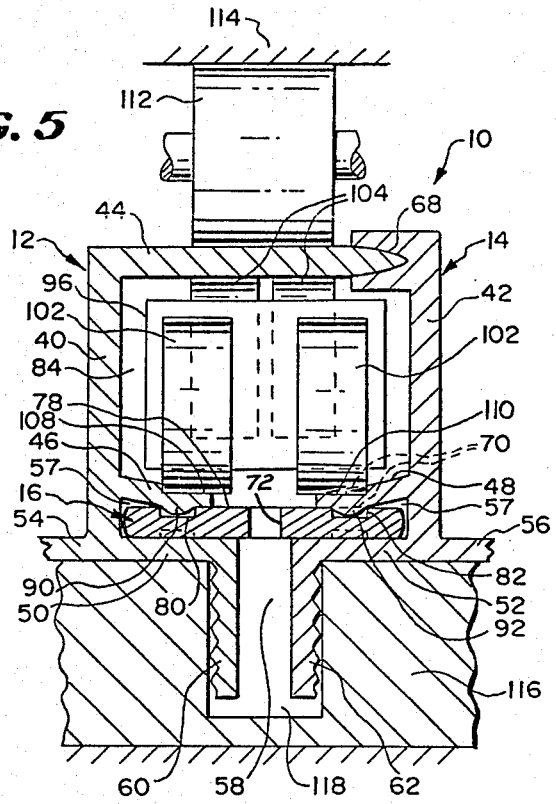
FIG. 5 is a fragmentary sectional view taken through the so-called box-like housing of the stud adapter of the invention illustrating the manner in which the same is assembled with the slotted steel standard.
Figure 7:
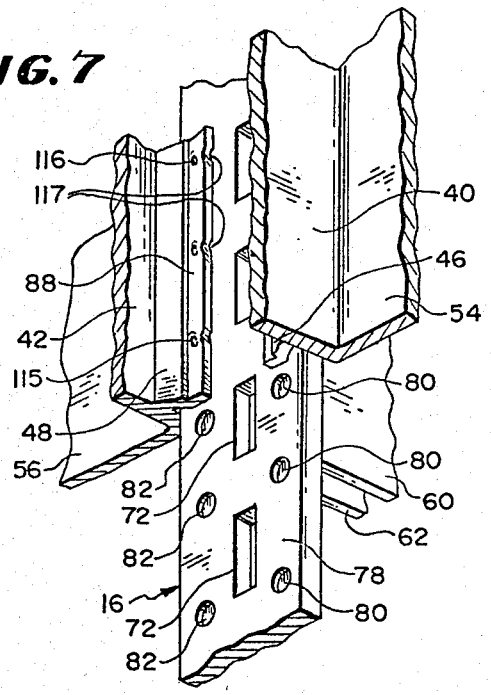
FIG. 7 is a fragmentary perspective view of the stud adapter of the invention taken from the rear of the slotted standard with most of the box-like housing broken away to show the manner in which the slotted standard is locked to the box-like housing.

Because of this structure, it is clear that passing the mandrel 94 through the chamber 84 will flatten the flanges to their distorted form shown in FIGS. 2, 5 and 7 and produce what is in effect a roll track or flattened lip on each flange. The flattened lip 108 is produced on the flange 46 and the flattened lip 110 is produced on the flange 48.

In carrying out this process it is necessary to provide a counter-support for the rolls 102 and 104. In FIG. 5 the rolls 104 are shown engaged against the inner surface of the rear wall 44 of the box-like housing for supporting the mandrel 94 while it is being pushed through the assembly of the parts 12, 14 and 16. On the exterior surface of the rear wall 44 there is illustrated a roll 112 which can be one of a series that has a matching roll for each of the roll 104 and is directly opposite the same. These rolls 112 would be mounted on some form of carrier to move with the mandrel 94 and themselves be backed up by a counter-support comprising a fixed frame or structural member 114.

The rolls 112 could be eliminated and the adapter 10 clamped into a fixture with the rear wall 44 backed up by a fixed structural base or frame similar to 114.

The same type of arrangement could be used to back up the rolls 102. In FIG. 5 the rolls 102 are backed up by the counter-support consisting of the fixed base member 116 which may have a slot 118 to accommodate the entrance flanges 60 and 62 while the flanges 46 and 48 are being rolled to produce the locking keys 90 and 92.

FIG. 7 has been drawn to show the interior of the boxlike housing of the adapter 10, the rear wall 44 and portions of the side walls 40 and 42 being broken away. The view shows the adapter from the rear thereof such that the rear surface 78 of the standard 16 is clearly seen in its final disposition. The two rows of recesses 80 and 82 are shown as are the slots 72. The walls 40 and 42 have the interior flanges 46 and 48 covering the recesses 80 and 82. The flange 48 can be clearly seen here as having the flattened lip 88 which has been produced by the rolling of the flange 48.

The rolling of the flanges 46 and 48 causes the flow of aluminum from these flanges into the recesses 80 and 82 to form the locking keys 90 and 92 (FIG. 5) which have been mentioned. It has been found that the rolling action is so complete and efficient that one can see slight dimpling on the surface of the lips and even the edges of the lips overlying the surface 78 present evidence of the interior movement of metal by slight distortions adjacent each recess. The dimpling is indicated at 115 and the distortions at 117 in FIG. 7.

In order to prevent the slotted standard 16 from being mounted wrongly in the assembled adapter during its manufacture rows of recesses are provided on both of its surfaces. Thus, in addition to the rows of recesses 80 and 82 additional rows of recesses 120 and 122 are provided on the opposite surface 124 of the standard 16 adjacent opposite lateral edges.

Preferably these rows of recesses 120 and 122 are located staggered relative to the recesses 80 and 82 so that the bar will not be weakened or have a tendency to bend during handling.

Obviously whichever surface faces the rear of the box-like housing will comprise the rear surface of the standard 16, whether it is the surface 78 or the surface 124.

Figure 8:
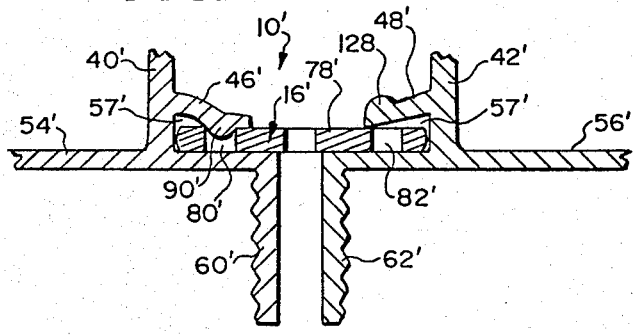
FIG. 8 is a fragmentary sectional view through the stud adapter but showing a modified form of the invention.

It is possible to drill holes completely through the standard 16 to have the same effect as recesses on opposite surfaces of the standard. In FIG. 8, in the modified form of adapter 10', such a standard is shown at 16' there being rows of holes 80' and 82' adjacent the opposite edges. The standard 16' is assembled into the channel 57' and the flanges 46' and 48' are rolled onto the surface 78'. The locking keys such as 90' will be formed and extruded into the holes 80' and 82'. The flanges 46' and 48' may be of a configuration providing an upwardly protruding bead such as shown at 128 before rolling in order to provide additional metal to be pressed into the holes 80' and 82' . This will provide longer locking keys and will leave more material on the exterior of the standard 16' then was available for the flanges on the exterior of the standard 16 of FIGS. 1, 2, 5 and 7.

Figure 4:
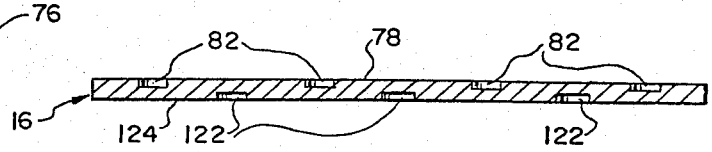
FIG. 4 is a sectional view taken through the slotted steel standard of FIG. 3 along the line 4—4 and in the indicated direction.
Figure 9:
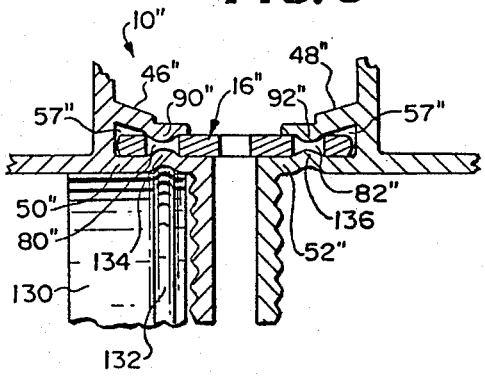
FIG. 9 is a view similar to that of FIG. 8 but showing another modified form of the invention.

In FIG. 9 another modified form of the invention is shown in which again the standard 16'' has holes 80'' and 82'' drilled therethrough. The flanges 46'' are substantially the same as those of FIGS. 1, 2, 5 and 7 and they are shown rolled in place to form the locking keys 90'' and 92''. In this case, while the flanges 46'' and 48'' are being rolled, a pair of rolls, one of which is shown at 130, is engaging the extensions 50'' and 52'' from the front of the adapter 10'' and an annular ring 132 formed on the roller presses the aluminum into the front ends of the holes 80'' and 82'' to form additional locking keys 134 and 136, this being effected from the front of the adapter. Obviously such an arrangement could be used with the standard 16 of FIGS. 3 and 4. This version of the invention provides additional locking securement of the standard to the adapter but such added securement is normally not necessary.

The adapter of the invention is used when a constructor is building a wall that is intended to have shelving supported thereon. He purchases lengths of the adapter 10 all assembled. In building the wall, the constructor frames out the wall with the conventional steel studs, fixing them in place wherever needed or wherever the building code requires. As stated, this could be on sixteen inch centers. Wherever he intends to install an adapter of the invention he erects a pair of steel studs back-to-back and separated by the width of the adapter which will be typically one inch. Sufficient support for most shelving can be provided where the adapters are 48 inches apart.

The constructor now fits an adapter between each pair of back-to-back sheet metal studs and by reference to the location of the slots within the adapters which he can readily see and locate, he secures all of the adapters for a given set of shelves in place. This is done by having all of the slots of the series of adapters horizontally aligned and such alignment level.

Securement is effected by first attaching the adapters to the studs by the use of the screws 36 and 38. Thereafter, the wallboard members such as 24 and 26 are cut to size and fitted in place. These are then secured by means of the screws 28 and 30, passing through the wallboard, the wings 54 and 56 and the stud flanges 34. Other screws may be used to secure the wallboard members to other studs spaced from those forming the support for the adapter 10.

After this has been done, the adapter 10 is completely hidden but for the groove 58.

Many variations are capable of being made in the details of the structure and the method without departing from the spirit or scope of the invention. For example, instead of the recesses or holes in the standard, it could be provided with a series of transverse grooves much like knurling, sufficiently deep so that the flanges will form locking keys entering these grooves when the flanges are rolled against the surface of this standard.

What it is desired to secure by letters patent of the United States is:

1. A method of making an adapter for holding a slott ed standard in the form of a flat bar having longitudinally spaced slots along a center line thereof to a pair of back to-back studs in a wall construction, the adapter comprising a box-like housing having a rear wall, a pair of side walls, front wallboard supporting wings with inner extensions that stop short of one another and have right angle spaced apart parallel entrance flanges formed thereon, a pair of inwardly extending flanges spaced rearwardly of the extensions and forming therewith a split channel for receiving the flat bar and with the slots of the bar aligned with the space between the entrance flanges, said method comprising:

A. forming recesses in at least one of the faces of said flat bar between said slots and opposite parallel edges of said bar, B. assembling the flat bar in said split channel together with said housing, C. rolling portions of at least one of said extensions and inwardly extending flanges into said recesses between said slots and said opposite parallel edges of said bar to form locking keys for holding the flat bar and the adapter in assembly.

2. The method as claimed in claim 1 in which the recesses are formed in at least one face of said bar and said bar is mounted with the recesses opening to the rear thereof and the inwardly extending flanges are rolled into said recesses from the interior of said housing.

3. The method as claimed in claim 1 in which the adapter is formed of two extruded parts which face one another and which are mirrors of one another except for tongue and groove elements on respective parts and the tongue and groove elements are adapted to be frictionally engaged, said method including in addition to the steps of claim 1 assembling the two extruded parts and the flat bar together by laterally arranging them with respect to one another and forcing the two parts together confining said flat bar before said rolling step.

4. The method as claimed in claim 2 in which the adapter is formed of two extruded parts which face one another and which are mirrors of one another except for tongue and groove elements on respective parts and the tongue and groove elements are adapted to be frictionally engaged, said method including in addition to the steps of claim 1 assembling the two extruded parts and the flat bar together by laterally arranging them with respect to one another and forcing the two parts together confining said flat bar before said rolling step.

5. The method as claimed in claim 2 in which the recesses are formed in both faces of said bar and the bar is mounted without regard to which recesses open to the rear thereof.

6. The method as claimed in claim 1 in which recesses are formed in both faces of said bar and in which portions of both the extensions and inwardly extending flanges are simultaneously rolled into said recesses.

* * * * *